US005861570A

United States Patent [19]

Bickes, Jr. et al.

[11] Patent Number: 5,861,570

[45] Date of Patent: Jan. 19, 1999

[54] SEMICONDUCTOR BRIDGE (SCB) DETONATOR

[75] Inventors: Robert W. Bickes, Jr.; Mark C. Grubelich, both of Albuquerque, N. Mex.

[73] Assignee: Sandia Corporation, Albuquerque, N. Mex.

[21] Appl. No.: 636,626

[22] Filed: Apr. 23, 1996

[51] Int. Cl.[6] ..... F42B 3/10

[52] U.S. Cl. ..... 102/202.7; 102/202.9

[58] Field of Search ..... 102/201, 202.5, 102/202.7, 202.9, 202.14, 221

[56] References Cited

U.S. PATENT DOCUMENTS

| | | | |
|---|---|---|---|
| H1366 | 11/1994 | Bickes, Jr. et al. | 102/202.5 |
| 2,986,803 | 6/1961 | Stresau et al. | 29/592.1 |
| 3,160,789 | 12/1964 | Morgan | 102/206 |
| 3,181,464 | 5/1965 | Parker et al. | 102/202.7 |
| 3,366,055 | 1/1968 | Hollander | 102/206 |
| 3,663,855 | 5/1972 | Boettcher | 313/556 |
| 4,708,060 | 11/1987 | Bickes, Jr. et al. | 102/202.7 |
| 4,840,122 | 6/1989 | Nerheim et al. | 102/202.5 |
| 4,862,803 | 9/1989 | Nerheim et al. | 102/202.5 |
| 4,976,200 | 12/1990 | Benson et al. | 102/202.7 |
| 5,309,841 | 5/1994 | Hartman et al. | 102/202.4 |
| 5,503,077 | 4/1996 | Motley | 102/202.5 |

FOREIGN PATENT DOCUMENTS

| | | | |
|---|---|---|---|
| 93/24803 | 12/1993 | WIPO | 102/202.5 |
| 94/19661 | 9/1994 | WIPO | 102/202.15 |

*Primary Examiner*—Charles T. Jordan
*Assistant Examiner*—Matthew J. Lattig
*Attorney, Agent, or Firm*—Timothy D. Stanley

[57] ABSTRACT

The present invention is a low-energy detonator for high-density secondary-explosive materials initiated by a semiconductor bridge igniter that comprises a pair of electrically conductive lands connected by a semiconductor bridge. The semiconductor bridge is in operational or direct contact with the explosive material, whereby current flowing through the semiconductor bridge causes initiation of the explosive material. Header wires connected to the electrically-conductive lands and electrical feed-throughs of the header posts of explosive devices, are substantially coaxial to the direction of current flow through the SCB, i.e., substantially coaxial to the SCB length.

19 Claims, 2 Drawing Sheets

SEMICONDUCTOR BRIDGE (SCB) DETONATOR

I. GOVERNMENT RIGHTS

This invention was made with United States Government support under Contract No. DE-AC04-76DP00789 awarded by the U.S. Department of Energy. The Government has certain rights in this invention.

II. BACKGROUND OF THE INVENTION

The present invention relates generally to detonators. More specifically, the present invention relates to a semiconductor bridge ("SCB") initiated detonators for explosive materials.

Most electro-explosive (e.g., bridge wire or metal foil) devices contain a small metal bridge wire heated by a current pulse from a firing set with nominal output voltages ranging from one to several tens of volts. In order to obtain environmental tolerance along with acceptable shelf-life, electro-explosive devices are usually designed with hermetically sealed housings with electrical feed-throughs. Additionally, thermally-initiated devices must be able to withstand reasonable, unintended currents without firing because relatively-low energies are required to cause firing of the devices. Any current will produce some heating of the bridge wire and most designs of thermally-initiated devices have limited capability to transport this heat away from the thermally-sensitive explosive material. Heat transport from the bridge wire to an exoergic material next to the wire is a thermally-conductive process that produces an explosive output, typically a few milliseconds after the start of the current pulse. "No fire" (the maximum current that can be applied to the bridge wire for a specified period of time without causing ignition) and all-fire (the minimum current level required for reliable ignition) current levels are dependent upon the exoergic material and the physical configuration of the explosive device.

The inexpensive and reliable ignition of explosive materials is a desirable goal for both economic and safety reasons. U.S. Pat. No. 4,708,060, Semiconductor Bridge (SCB) Igniter, of Bickes, Jr. et al. depicts a semiconductor bridge ("SCB") igniter that satisfies this goal. The SCB igniter comprises a small, doped polysilicon or silicon layer formed on a non-conducting substrate (e.g., silicon or sapphire). The heavily doped, approximately one ohm, SCB is formed between two spaced conductive lands (e.g., metal such as aluminum) and in contact with an explosive material. The length of the SCB is determined by the spacing of the conductive lands; SCBs are nominally 100 $\mu$m long and 380 $\mu$m wide and the doped layer is typically two $\mu$m thick. The conductive lands provide a low ohmic contact to the underlying doped layer. SCB resistance at ambient conditions is typically one ohm. Header wires are bonded to the conductive lands and the electrical feed-throughs on the explosive header posts to permit a current pulse to flow from land-to-land along the current flow axis of the SCB.

U.S. Pat. No. 4,976,200, A Tungsten Bridge for the Low Energy Ignition of Explosive and Energetic Materials , of Benson et al., depicts a tungsten SCB that includes a substrate covered by a layer of an insulating material such as silicon dioxide, a semiconductor bridge on the surface of the layer of the insulating material, and a pair of conductive lands deposited over the semiconductor bridge. The semiconductor bridge includes a first layer of an insulating material, which comprises silicon, in contact with the substrate and a second layer, which includes tungsten, selectively deposited only over the entire first layer. A pair of electrical conductors are each connected to one of the lands and a power source is connected to the electrical conductor for supplying current to the lands.

The SCB is easily designed to not fire when a "no fire" current is applied, but to fire when a higher "fire" current is applied. As disclosed in U.S. Pat. No. 4,708,060, application of a 15 amps, 15 $\mu$s current pulse through the SCB produces a plasma discharge that ignites the explosive material at a relatively slow rate. Such ignition is suitable for actuators, gas generators, and rocket motors, but is not fast enough for other applications.

In some applications, high-explosive powders are initiated, as opposed to ignited, by the direct output from a bridge wire or metal foil (see for example, exploding bridge wire ("EBW") devices). These devices can often use more stable explosive materials, which is an important safety consideration.

U.S. Pat. No. 4,862,803, Integrated Silicon Secondary Explosive Detonator, of Nerheim et al. depicts a detonator device for primary or secondary explosive materials comprising an integrated circuit consisting of a silicon wafer substrate on which an epitaxial layer of a desired thickness is first grown, followed by a covering insulating oxide layer. U.S. Pat. No. 4,862,803 claims back-etching the silicon wafer to define a barrel for a flyer plate.

U.S. Pat. No. 4,840,122, Integrated Silicon Plasma Switch, of Nerheim depicts a switch device for use in detonation systems and for one-time use in conducting very high currents. The switch device comprises a silicon substrate on which is deposited an amorphous silicon or polysilicon strip extending as a bridge between first and second lands deposited on the silicon substrate. Also deposited on the same substrate on opposite sides of the bridge and spaced from it are a set of high-voltage contacts. Unlike the present invention, U.S. Pat. No. 4,840,122 depicts the use of an extra pair of electrodes. When a high voltage is applied across the contacts, no current flows until a trigger current is made to flow through and vaporize the bridge.

Statutory Invention Reg. No. H 1,366, SCB Initiator, of Bickes, Jr., et al. depicts a detonator device for high-explosive materials initiated by mechanical impact of a flying plate, the detonator device includes a cylindrical barrel, a layer of flyer material mechanically covering the barrel at one end, and a SCB igniter that includes a pair of electrically-conductive pads connected by a SCB. The SCB is in operational contact with the layer through the barrel to detonate the explosive material. Unlike the present invention, the detonator device described in Statutory Invention Reg. No. H 1,366 does not teach the necessary header wire orientation, which is critical to the operation of the detonator.

The present invention uses a high-current pulse to cause a SCB to function similar to an EBW detonator. The present invention provides a low-inductance firing system to discharge into a SCB to initiate it, similar to an EBW detonator. Also, the present invention uses a SCB for direct and very prompt initiation of a high-explosive material. In one embodiment, the present invention provides a laser to arm an undoped SCB for direct initiation. The embodiments disclosed herein have a current conduction scheme, e.g., header wires connecting the SCB lands to the header posts of explosive devices, that is substantially parallel to the direction of current flow through the SCB.

III. SUMMARY OF THE INVENTION

The present invention is a detonator for an explosive material (e.g., exoergic), comprising a semiconductor bridge igniter, the semiconductor bridge igniter including a pair of electrically-conductive lands connected by a semiconductor bridge, the semiconductor bridge having a length, the semiconductor bridge being in contact with the explosive material, whereby ignition of said semiconductor bridge causes initiation of the explosive material; and current conduction means for producing current flow substantially parallel to the semiconductor bridge length. The SCB igniter can be in operational or direct contact with the explosive material. The detonator further comprises an input means for igniting the SCB igniter. The embodiments discussed herein have a current conduction means, such as header wires connecting the SCB lands to the header posts of explosive devices, that are substantially parallel to the direction of current flow through the length of the SCB, i.e., substantially parallel to the SCB length. The current conduction means described herein can be employed wherever exploding bridge wire (EBW) devices are used today, such as in special blasting operations, demolition, petrochemical operations, etc.

The novel features of the present invention will become apparent to those of ordinary skill in the art upon examination of the following detailed description of the invention or can be learned by practice of the present invention. It should be understood, however, that the detailed description of the invention and the specific examples presented, while indicating certain embodiments of the present invention, are provided for illustration purposes only because various changes and modifications within the spirit and scope of the invention will become apparent to those of ordinary skill in the art from the detailed description of the invention and claims that follow.

IV. BRIEF DESCRIPTION OF THE DRAWINGS

The accompanying figures, which are incorporated in and form part of the specification, further illustrate the present invention and, together with the detailed description of the invention, serve to explain the principles of the present invention.

Figure 3:
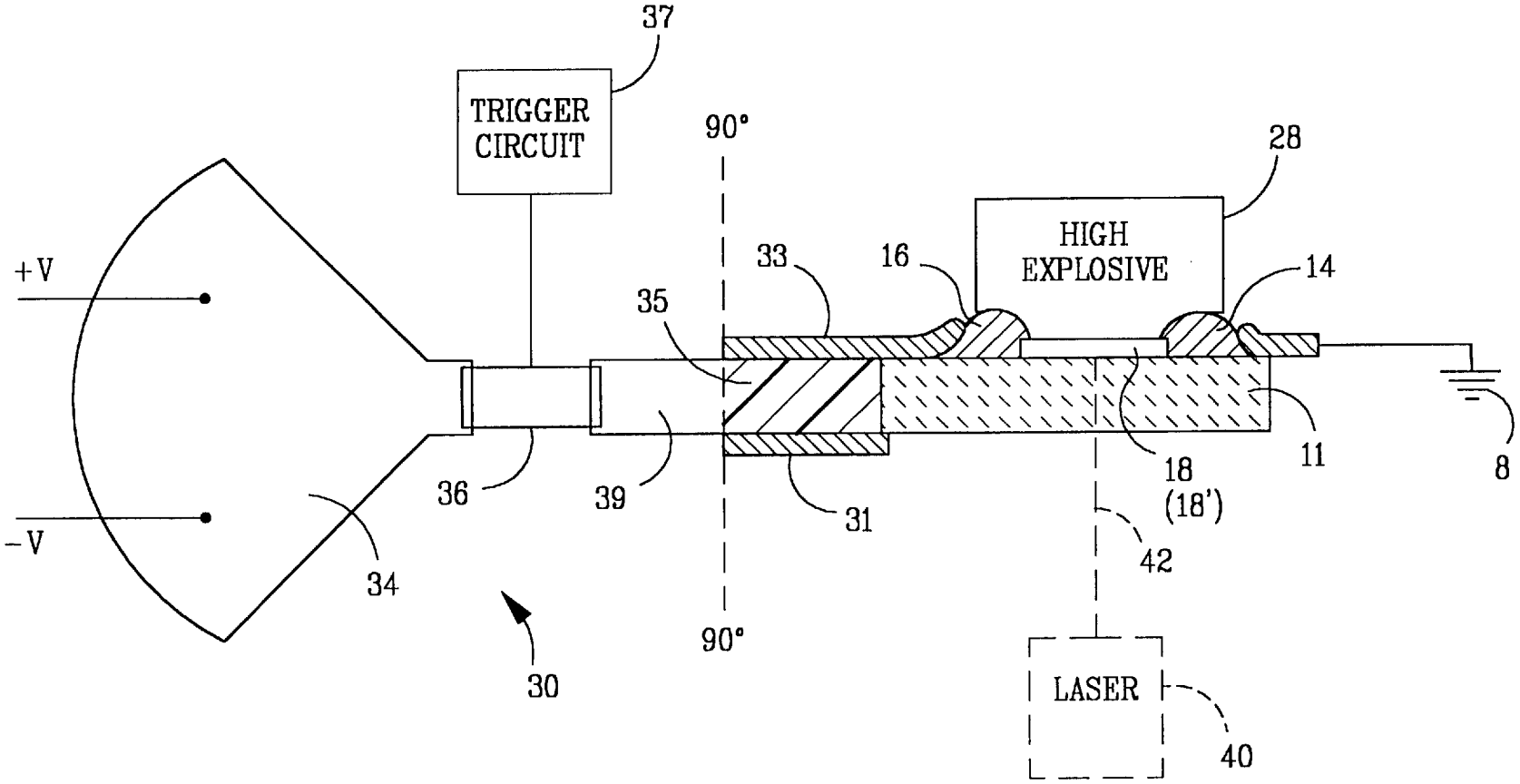

FIG. 3 is a top view of a low-inductance input circuit 30 shown to the left of the dashed vertical line marked 90° while a cut-away side view is shown for the detonator assembly to the right of the dashed vertical line marked 90°.

V. DETAILED DESCRIPTION OF THE INVENTION

The present invention is a low-energy detonator for high-density secondary-explosive materials initiated by a SCB igniter that includes a pair of electrically-conductive lands or pads connected by a SCB. Low energy, as used herein, refers to energy less than 100 mJ, high-density implies greater than 50% of the theoretical maximum density and secondary explosive materials including PETN, HNS, RDX, HMX, TATB, PBX series, etc. The SCB is in operational or direct contact with the explosive material, whereby ignition of the SCB causes a detonation of the explosive material. Input means are provided for igniting the SCB igniter through a current conduction means. The present invention discloses embodiments having current conduction means, such as header wires connecting the SCB lands to the header posts of explosive devices, that are substantially parallel to the direction of the current flow through the SCB, i.e., parallel to the SCB length.

Figure 1:
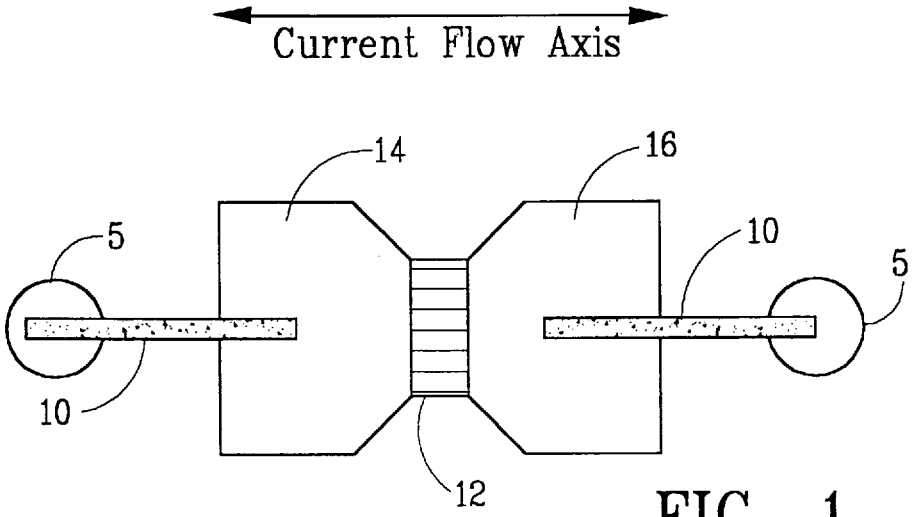
FIG. 1 illustrates a current conduction configuration that optimizes the detonation or initiation of the device of the present invention.

Referring to FIG. 1, there is shown a SCB 12 between conductive (e.g., metallized) lands 14 and 16. Header wires 10 are connected (for example, bonded by ultrasonic bonds, thermocompressive bonds, or TAB bonds, edge metallization, etc.) to the lands 14 and 16 and the electrical feed-throughs on the header posts 5 of the explosive to permit a current pulse to flow from land-to-land through the SCB 12. Header wires 10 are connected to the lands 14 and 16 in a configuration that is substantially parallel to the direction of current flow through the SCB 12, i.e., substantially parallel to the length of the SCB 12. It is an important and significant feature of the present invention that the header wires 10 be connected substantially in parallel to the direction of the current flow axis through the SCB 12 as shown in FIG. 1. It would appear that the orientation of the header wires would have no bearing on the current provided to the SCB along its current flow axis. However, if the current conduction means depicted in FIG. 1 and described herein are not employed, then the SCB explosive devices will neither detonate nor initiate—which is an unexpected result.

Figure 2:
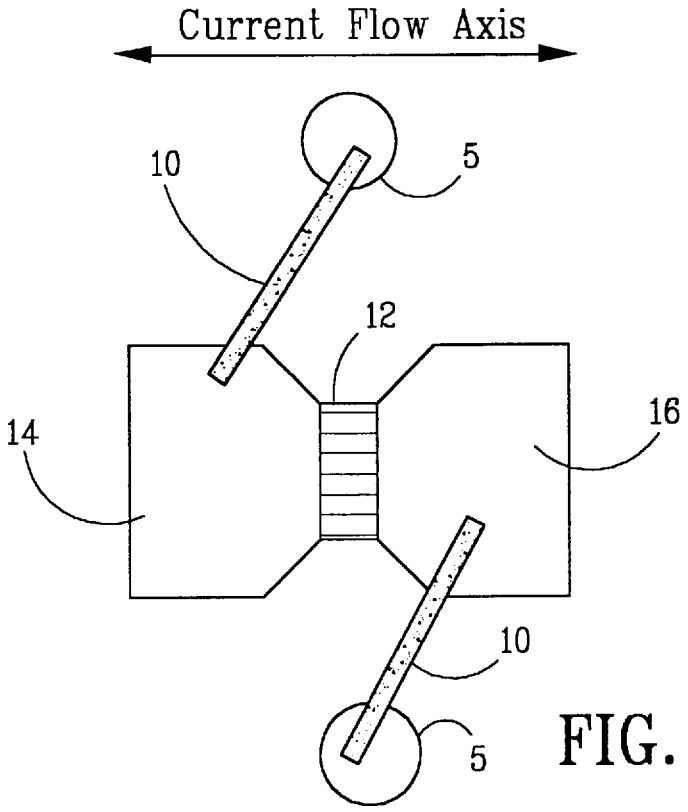
FIG. 2 illustrates a current conduction configuration that prevents the detonation or initiation of the device of the present invention.

Referring to FIG. 2, there is shown a SCB 12 and lands 14 and 16 as described above for FIG. 1. FIG. 2, however, depicts the header wires 10 connected substantially perpendicular to the current flow axis of the SCB 12, which is incorrect. If the current conduction scheme depicted in FIG. 2 and described herein is followed, then the SCB explosive devices will neither detonate nor initiate.

Referring to FIG. 3, SCB 12 typically includes a highly-doped silicon layer 18 on a substrate 11 and having lands 14 and 16 at opposite ends, forming a SCB layer 18 therebetween. Lands 14 and 16 can be connected to input circuit 30 by solder connections (not shown), or by other methods such as thermocompressive bonds, ultrasonic bonds or TAB bonds, edge metallization, etc. Examples of high-explosive material 28 that are suitable for use in the present invention include PETN or HNS.

FIG. 3 shows an embodiment of the invention where the energy of the SCB 12 directly ignites a high-explosive material 28 upon the application of a current pulse. A current pulse through the SCB causes it to burst into a bright plasma discharge that heats the explosive material pressed against the SCB by a rapid and efficient convective process. Consequently, SCB devices operate at input energies typically less than five mJ and as low as 30 $\mu$J. However, SCB devices function very quickly producing an explosive output in less than 60 $\mu$s for pyrotechnic devices. Despite the low energy required for ignition, the substrate provides a reliable heat sink for excellent no fire levels. In addition, the devices are electrostatic discharge and radio frequency tolerant. Because the physics of SCB operation is so very much different than for hot wires, SCB devices have both low-input energy requirements and high no fire levels.

For a SCB as disclosed in U.S. Pat. No. 4,708,060, layer 18 can be either doped silicon or polysilicon, and substrate 11 can be either sapphire or silicon. However, an alternative embodiment of the present invention is a layer 18 that is an undoped silicon bridge layer 18'. Undoped silicon layer 18' is undoped silicon with a high impedance that normally acts as an open switch in the circuit. Substrate 11 is sapphire or other material transparent to laser beam 42. FIG. 3 is shown to include laser 40 which focuses laser beam 42 on and through substrate 11. Irradiation of undoped silicon layer 18' by laser beam 42 of sufficient energy and appropriate wavelength creates electrical carriers in the silicon via the photoconductive effect, thereby reducing the impedance of layer 18' to approximately one ohm. Application of the input signal during this laser application causes ignition in a manner similar to the doped SCB 12 discussed above.

In an alternative embodiment, the tungsten SCB presented by Benson et al., A Tungsten Bridge for the Low Energy Ignition of Explosive and Energetic Materials, U.S. Pat. No. 4,976,200, can be used in place of the SCB 12 as discussed above.

Referring to FIG. 3 again, a top view of a low-inductance input circuit 30 is shown to the left of the dashed vertical line marked 90° while a cut-away side view is shown for the detonator assembly to the right of the dashed vertical line marked 90°. The assembly to the left of the vertical line marked 90° is the input circuit 30 for providing sufficient electrical energy to the SCB 12, through a current conduction means, to ignite the SCB 12 and detonate the high-explosive material 28. The SCB 12 can be doped silicon layer 18 on an insulating substrate 35; SCB 12 can also be undoped silicon layer 18' on sapphire substrate 11 with irradiation by laser 40 as discussed above. Land 16 is connected to the input circuit 30; land 14 is connected to ground 8. High-explosive material 28 is in direct contact with the SCB layer 18 or 18'. When sufficient energy is applied from input circuit 30, the SCB ignites with sufficient energy to initiate the explosion.

In operation, when a low-inductance input circuit 30 provides a fast rise-time pulse on the order of 1000 amps to SCB layer 18, the SCB layer 18 vaporizes and explodes with sufficient energy to burst the SCB 12 and cause a strong shock into the explosive material, e.g., exoergic material such as PETN or HNS. This operation differs from the teaching of U.S. Pat. No. 4,708,060 in that a SCB could safely be ignited with a relatively low-power source.

A low-inductance (e.g., 0.02 $\mu$F) capacitor 34 is preferably formed from approximately a two-foot arc of a one-foot radius circle of stripline material including top and bottom thin metallic films 33 and 31 separated by an insulating Kapton layer 35 having a thickness on the order of one to three millimeters. Commercially-available capacitors can also be used as capacitor 34 in accordance with the present invention. A dc voltage (V+), preferably on the order of one to three kV, is applied to one surface of capacitor 34; the return voltage (V−) is applied to the opposite surface of capacitor 34. The stripline forming the one surface of capacitor 34 extends, as short a distance as possible to minimize inductance, to the input terminal of a low-inductance, high-voltage, fast, electronic switch 36. A suitable switch for use in the present invention is disclosed in U.S. Pat. No. 3,663,855. The trigger for switch 36 is connected to a trigger circuit 37 in a manner well known to those of ordinary skill in the art and will not be discussed herein. The output of switch 36 is connected by a short stripline section 33 to the land 16 of the SCB preferably by solder connections (not shown), or by other connection methods such as thermocompressive bonds, ultrasonic bonds or TAB bonds, edge metallization, etc. SCB substrate 11 covers the side of layer 18 opposite lands 16 and 14.

Other variations and modifications of the present invention will be apparent to those of ordinary skill in the art, and it is the intent of the appended claims that such variations and modifications be covered. The particular values and configurations discussed above can be varied and are cited merely to illustrate a particular embodiment of the present invention and are not intended to limit the scope of the invention. It is contemplated that the use of the present invention can involve components having different characteristics as long as the principle, using a low-inductance input circuit to fire a SCB, with the proper header wire orientation positioned substantially in parallel with the current flow through the length of the SCB to detonate high-explosive materials, is followed. It is intended that the scope of the present invention be defined by the claims appended hereto. The entire disclosures of all references—patents, patent applications, or publications—cited herein are hereby incorporated by reference.

We claim:

1. A detonator for an explosive material, comprising:

a semiconductor bridge igniter, said semiconductor bridge igniter including a pair of electrically conductive lands connected by a semiconductor bridge, the semiconductor bridge being in contact with the explosive material, whereby current flow throughout the semiconductor bridge causes initiation of the explosive material; and current conductor means for producing current flow through the semiconductor bridge, wherein the current conductor means comprises two wires each connected to one of the electrically conductive lands such that the flow path of current, from the point of connection of one wire to a first electrically conductive land through the semiconductor bridge to a second land to the point of connection of a second wire to the second electrically conductive land, is substantially coaxial, along its entire flow path, with the semiconductor bridge.

2. The detonator of claim 1, further comprising input means, connected to said current conduction means, for igniting said semiconductor bridge igniter.

3. The detonator of claim 2, wherein said input means comprises:

capacitor means for storing electrical energy; and switch means for switching electrical energy, said switch means having an input port connected to said capacitor means, an output port connected to said semiconductor bridge igniter, and a trigger port for receiving a trigger signal for closing said switch means to fire said semiconductor bridge igniter.

4. The detonator of claim 1, wherein the explosive material is a secondary-explosive material.

5. The detonator of claim 1, wherein the semiconductor bridge is in direct contact with the explosive material.

6. The detonator of claim 1, wherein the semiconductor bridge is in operational contact with the explosive material.

7. The detonator of claim 1, wherein the semiconductor bridge is doped.

8. The detonator of claim 1, wherein the semiconductor bridge is not doped.

9. The detonator of claim 1, wherein the semiconductor bridge is undoped silicon.

10. The detonator of claim 1, wherein the semiconductor bridge is doped silicon.

11. The detonator of claim 1, wherein the semiconductor bridge is doped polysilicon.

12. The detonator of claim 1, wherein the semiconductor bridge comprises a first layer of silicon in contact with a substrate and a second layer of tungsten deposited only over the entire first layer.

13. The detonator of claim 1, wherein the semiconductor bridge is deposited on a substrate.

14. The detonator of claim 13, wherein the substrate is silicon.

15. The detonator of claim 13, wherein the substrate is sapphire.

16. The detonator of claim 1, further comprising:

laser means for directing a laser beam onto the semiconductor bridge to reduce the impedance of the semiconductor bridge.

17. A detonator for a secondary explosive material, comprising:

a. a semiconductor bridge igniter, wherein the semiconductor bridge igniter includes a pair of electrically conductive lands connected by a semiconductor bridge; and b. two conductors, wherein one end of each conductor is connected on a separate electrically conductive land and the connections to each land, the lands and the semiconductor bridge are substantially coaxially aligned.

18. The detonator of claim 17, wherein the secondary explosive material has a density of greater than 50% of its theoretical maximum density.

19. The detonator of claim 17 wherein the secondary explosive material is selected from the group consisting of PETN, HNS, RDX, HMX, TATB, and PBX series.

* * * * *